US008136957B1

(12) United States Patent
Balcarran

(10) Patent No.: US 8,136,957 B1
(45) Date of Patent: Mar. 20, 2012

(54) REMOTE CONTROL CADDY WITH SUPPORT MEANS

(76) Inventor: Sylvet Balcarran, Bronx, NY (US)

( * ) Notice: Subject to any disclaimer, the term of this patent is extended or adjusted under 35 U.S.C. 154(b) by 399 days.

(21) Appl. No.: 12/462,877

(22) Filed: Aug. 11, 2009

Related U.S. Application Data

(60) Provisional application No. 61/188,481, filed on Aug. 11, 2008.

(51) Int. Cl.
*F21V 33/00* (2006.01)

(52) U.S. Cl. ..... 362/154; 383/2

(58) Field of Classification Search ..... 362/84, 362/132, 154, 156, 217.01, 217.02, 219, 362/227, 236, 240, 249.01, 249.02, 249.04, 362/249.14, 249.15, 249.16, 800, 806; 383/6, 383/7, 38, 39; 5/482, 493, 497, 499, 503.1, 5/658; 224/156, 584, 932
See application file for complete search history.

(56) References Cited

U.S. PATENT DOCUMENTS

| | | | | |
|---|---|---|---|---|
| 1,089,939 | A * | 3/1914 | Maxwell | 150/150 |
| 2,911,024 | A * | 11/1959 | Miceli | 150/113 |
| 2,988,125 | A * | 6/1961 | Reynolds | 206/316.2 |
| 3,203,612 | A * | 8/1965 | Schaefer | 229/120.36 |
| 4,428,484 | A * | 1/1984 | Rattay et al. | 206/548 |
| 4,461,442 | A | 7/1984 | Keenan | |
| 4,542,826 | A * | 9/1985 | Adams | 206/427 |
| 4,738,363 | A * | 4/1988 | Hudson | 206/427 |
| 4,842,032 | A * | 6/1989 | Mastronardo | 206/308.1 |
| 5,009,315 | A * | 4/1991 | Robare | 206/427 |
| 5,082,139 | A * | 1/1992 | Quam | 220/530 |
| D324,810 | S | 3/1992 | Moye, Sr. | |
| 5,095,718 | A * | 3/1992 | Ormond et al. | 62/457.5 |
| 5,370,246 | A * | 12/1994 | Traynor | 211/86.01 |
| D361,462 | S | 8/1995 | Newham | |
| 5,558,214 | A * | 9/1996 | Brundidge | 206/162 |
| 5,605,235 | A | 2/1997 | Johnson | |
| 5,609,282 | A * | 3/1997 | Melanson | 224/576 |
| 5,651,152 | A | 7/1997 | Ritchie et al. | |
| 5,758,513 | A * | 6/1998 | Smith | 62/457.5 |
| 5,785,239 | A * | 7/1998 | Campbell et al. | 229/120.36 |
| D420,510 | S | 2/2000 | Rotan | |
| 6,053,317 | A * | 4/2000 | Morris et al. | 206/433 |
| 6,065,727 | A | 5/2000 | Fitzgerald et al. | |
| 6,067,813 | A * | 5/2000 | Smith | 62/371 |
| 6,155,206 | A * | 12/2000 | Godshaw | 119/453 |
| 6,233,765 | B1 | 5/2001 | Verhulst | |
| 6,292,963 | B1 | 9/2001 | Couture | |
| 6,347,419 | B1 | 2/2002 | Kurtz | |
| 6,564,992 | B1 * | 5/2003 | Wegner | 229/117.35 |
| 6,594,836 | B1 | 7/2003 | Everson et al. | |
| 6,848,132 | B1 * | 2/2005 | Dale | 5/503.1 |
| 6,913,386 | B2 * | 7/2005 | Maher et al. | 383/38 |
| D522,750 | S | 6/2006 | Girod | |
| 7,131,152 | B2 | 11/2006 | Wootten, Jr. et al. | |
| 7,341,377 | B1 * | 3/2008 | Baxter | 383/38 |
| 7,565,974 | B2 * | 7/2009 | Adams, Jr. | 206/427 |
| 7,717,293 | B2 * | 5/2010 | Bellafatto et al. | 221/92 |
| 2006/0254950 | A1 * | 11/2006 | Barlog et al. | 206/538 |
| 2009/0173646 | A1 * | 7/2009 | Blomberg | 206/139 |

* cited by examiner

*Primary Examiner* — Hargobind S Sawhney
(74) *Attorney, Agent, or Firm* — Montgomery Patent Design, LLC; Robert C. Montgomery; Joseph T. Yaksich

(57) ABSTRACT

A holding apparatus for television remotes, pens/pencils, paper and other personal items intended for bedside use by hospital patients, is herein disclosed, comprising a plurality of pockets or pouches to hold said personal items. According to a preferred embodiment, a center pocket would hold larger items and a pair of outer pockets would hold narrow objects. The apparatus is secured by a pair of straps that originate from the top rear portion of the outer pouches and secures about the railing of the hospital bed.

11 Claims, 6 Drawing Sheets

REMOTE CONTROL CADDY WITH SUPPORT MEANS

RELATED APPLICATIONS

The present invention was first described in and claims the benefit of U.S. Provisional Application No. 61/188,481, filed Aug. 11, 2008, the entire disclosures of which are incorporated herein by reference.

FIELD OF THE INVENTION

The present invention relates generally to storage devices and, more particularly, to a storage apparatus that provides a means of organizing and storing personal items in close proximity to a seated or laying person.

BACKGROUND OF THE INVENTION

In a hospital or extended care facility scene, it is common to see bedridden patients constantly battling to keep their personal items organized in or near their bed. These items include a television remote control, pens, pencils, stationary, writing pads, books, and the like. While larger bedside tables can be used, such surfaces often become cluttered with food, flowers, containers or other larger items. Also, such tables are frequently pushed aside for medical tests, obtaining vitals, or other tasks, and are frequently not returned to the bedside area. Such smaller items can also become easily lost in the sheets and are a frequent cause of patient aggravation.

Similar aggravations are presented to physically challenged people who must spend much of the time in a seated or laying position in which similar items may slip between cushions, get lost underneath furniture, or are mislaid when temporally moved. Additionally, when a person may want these personal items it may be late at night when there is no one nearby to assist them and searching for the desired item is made increasingly difficult due to the lack of illumination in a dark room.

Attempts have been made to provide a means of holding and organizing personal items at bedside or similar location as can be seen by reference in several U.S. patents. These include U.S. Pat. No. 4,461,442, issued in the name of Keenan, which describes a pistol holster holder for a bedside; U.S. Pat. No. 5,370,246, issued in the name of Traynor, which describes a multipocketed article storage caddy for bedrails; U.S. Pat. No. 5,605,235, issued in the name of Johnson, which describes a remote control holder; U.S. Pat. No. 5,651,152, issued in the name of Ritchie et al., which describes a storage organizer for a hospital bed; U.S. Pat. No. 6,233,765, issued in the name of Verhulst, which describes a storage organizer for a cot; U.S. Pat. No. 6,292,963, issued in the name of Couture, which describes a bed pocket storage system secured to a sheet; and U.S. Pat. No. 6,347,419, issued in the name of Kurtz, which describes a clamp-on storage endboard for a cot.

Similarly, attempts have been made to provide bed clothing with storage pockets as can be seen by reference in U.S. Pat. No. 6,594,836, issued in the name of Everson et al., which describes a bed sheet with storage pouches; U.S. Pat. No. 6,848,132, issued in the name of Dale, which describes a bedside organizer placed over a bed; and U.S. Pat. No. 7,131,152, issued in the name of Wootten, Jr. et al., which describes a bed sheet with a side pocket.

Additionally, ornamental designs for holders, bags, and pockets exist, particularly, U.S. Pat. Nos. D 324,810, issued in the name of Moye, Sr.; D361,462, issued in the name of Newham; D 420,510, issued in the name of Girod; and D 522,750, issued in the name of Rotan. However, none of these designs are similar to the present invention.

However, several disadvantages still exist in these attempts. These examples have limited mounting locations due to their configuration and lack the versatility to be moved from a bed to a wheel chair or other article of furniture. Furthermore, these examples do not provide any means to assist a user in locating and identifying personal articles in low light situations.

While these devices do fulfill their respective, particular objectives, each of these references suffers from one or more of the aforementioned disadvantages.

Accordingly, there exists a need for a means by which basic personal items can be controlled and stored near a resting location without the disadvantages as listed above. The development of the present invention substantially departs from the conventional solutions and in doing so fulfills this need.

SUMMARY OF THE INVENTION

In view of the foregoing references, the inventor recognized, the aforementioned inherent problems and observed that there is a need for a means to store and organize personal articles near a bedside or other resting location in a simple and practical manner and thus, the object of the present invention is to solve the aforementioned disadvantages and provide for this need.

It is a further object of the present invention to provide a storage caddy which easily mounts to and is removed from bed rails of hospital beds, chairs, sofas, traditional beds, and the like.

Another is to provide a storage caddy having various article holding and organizing pockets which prevent items from becoming lost in bed linens or between cushions and reduces the aggravation of searching for lost items.

Another object is to provide a storage caddy having a fastening means that provides an adjustable and simple means of attaching to and detaching from an article of furniture.

Yet still another object is to provide a storage caddy that is easily transferred from one article of furniture to another article of furniture with the user.

Yet still another object is to provide a storage caddy with a plurality of storage pockets of varying sizes suited to hold large and small items.

Yet still another object is to provide a storage caddy having an integral illumination means to assist a user locate and identify a desired article in low light situations.

To achieve the above objectives, the present invention provides a remote control caddy with support means that holds and organizes a plurality of personal items of various sizes, such a television remotes, pens, pencils, paper, books, stationary and the like. The apparatus generally comprises a large center pocket and two (2) smaller outer pockets. The apparatus is removable fastened to an article of furniture via a at least two (2) straps, each originating from a top rear and secured around a railing of the bed or similar location such as, but not limited to: a wheel chair, sofa, or a table. The apparatus enables a bedridden or physically limited individual organize their personal items and simply and easily find them.

An opening of each pocket has an integral light source which encompasses the outer pocket rim which provides an illumination means to each pocket. The light source is internally connected to each pocket with electrical wiring.

Additionally, the present invention provides a method of utilizing the apparatus that provides for the simple organization of commonly used personal items at a resting location in a manner which is quick, easy, and effective and reduces the possibility of loss and associated aggravation.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
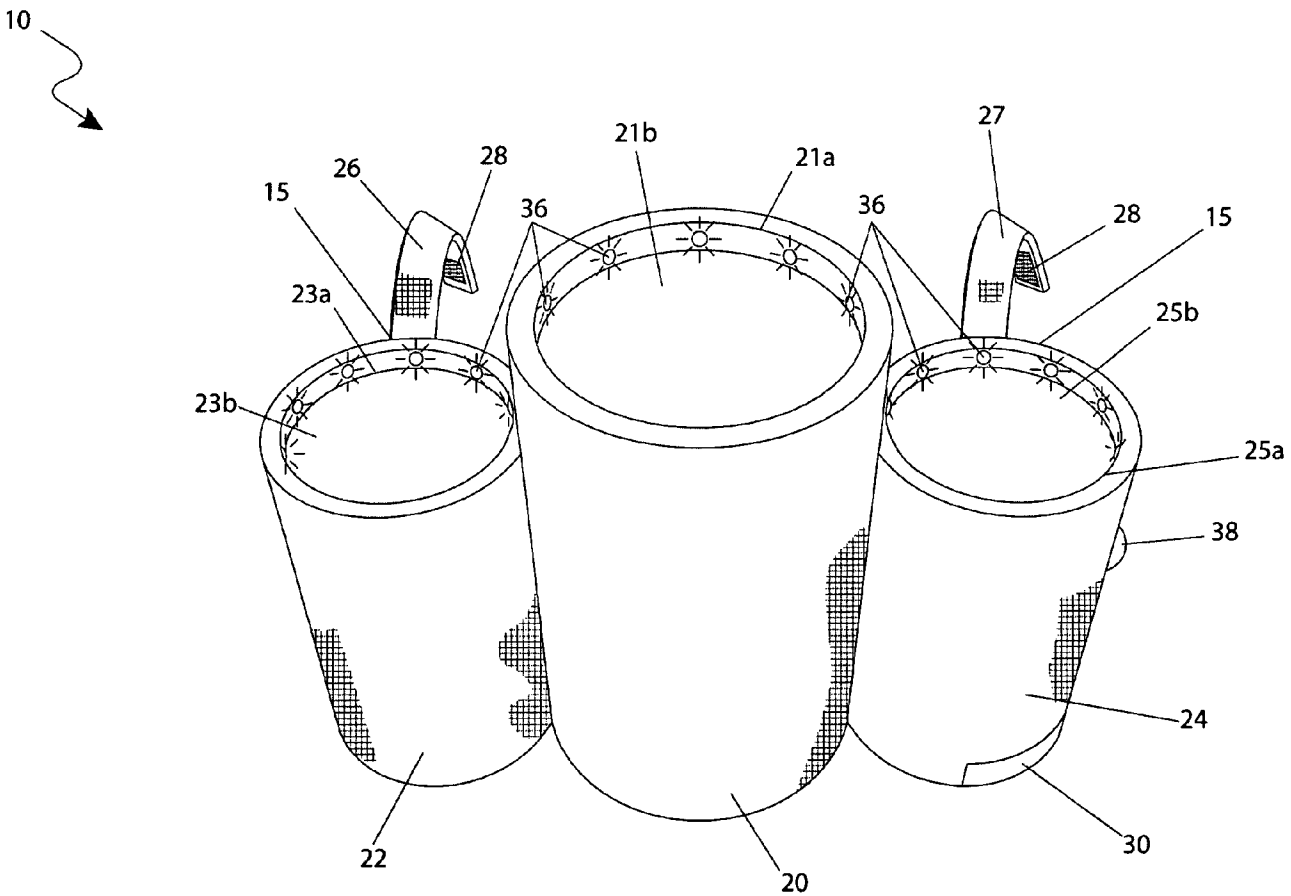
FIG. 1 is a front perspective view of a textile-based holding apparatus 10, according to a preferred embodiment of the present invention.

| | |
|---|---|
| 10 | remote control caddy with support means |
| 15 | top rear portion |
| 20 | center pocket |
| 21a | center pocket rim |
| 21b | center pocket opening |
| 22 | first outer pocket |
| 23a | first outer pocket rim |
| 23b | first outer pocket opening |
| 24 | second outer pocket |
| 25a | second outer pocket rim |
| 25b | second outer pocket opening |
| 26 | first strap |
| 27 | second strap |
| 28 | hook side |
| 29 | loop side |
| 30 | battery storage compartment |
| 32 | bottom portion |
| 34 | battery |
| 36 | light source |
| 38 | switch |
| 39 | electrical circuit |
| 40 | railing |
| 42 | bed |
| 50 | electrical wiring |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a remote control caddy with support means (herein described as the "apparatus") 10 for holding television remotes, pens/pencils, paper, and other personal items intended for bedside use by hospital patients, bedridden individual, or the like. The apparatus 10 comprises a center pocket 20, a first outer pocket 22, and a second outer pocket 24. The apparatus 10 is fastened via a first strap 26 and a second strap 27, each originating from a top rear portion 15 of the apparatus 10 and secured about a railing 40 of the bed 42. Said apparatus 10 may also be utilized thereon, various structures such as, but not limited to: a chair, a table, or the like. Said apparatus 10 allows a bedridden individual to organize their personal items and find them easier. Furthermore, the apparatus 10 prevents personal items from becoming lost in bed linens and reduces the stress and aggravation for said bedridden individuals in having to find lost personal items.

Referring now to FIG. 1, a front perspective view of the apparatus 10, according to the preferred embodiment of the present invention, is disclosed. The apparatus 10 comprises at least three (3) pouches or pockets; the center pocket 20 located therebetween the first outer pocket 22 and the second outer pocket 24. According to the preferred embodiment the center pocket 20 is sized at approximately eight (8) inches by six (6) inches and would retain larger personal items such as paper, small books, or the like. Said center pocket 20 comprises a circular center pocket opening 21*b*, thereby allowing a user to insert desired items therewithin. A top interior portion of the center pocket opening 21*b*, thereon the center pocket rim 21*a*, comprises a light source 36, thereby providing an illumination means to the center pocket 20 and allowing a user to locate items within the center pocket 20 in dimmed lighting situations. Said center pocket 20 is fabricated of various hardened textiles such as, but not limited to: a stiffened canvas, coated nylon, or the like and will be available in multiple colors to suit individual tastes or to complement an existing décor. The canvas will be cut according to various patterns and sewn together using conventional heavy duty sewing techniques.

The first outer pocket 22 and the second outer pocket 24 are each sized at approximately three (3) inches by six (6) inches and would retain narrower personal items such as television remotes, pens, pencils, cordless phones, or the like. The first outer pocket 22 and second outer pocket 24 comprise a first outer pocket opening 23*b* and second outer pocket opening 25*b*, respectively, thereby providing the user with an insertion means to desired items. Each opening 23*b*, 25*b* also comprises a light source 36 which encompasses the first outer pocket rim 23*a* and second outer pocket rim 25*a*, thereby providing an illumination means to each outer pocket 22, 24 similar to the center pocket 20. The light source 36 is internally interconnected to each pocket 20, 22, 24 therewith electrical wiring 50. Each said light source 36 is preferably a string of light-emitting diodes (LED's), yet other illuminating means may be utilized without limiting the functions of the apparatus 10. Furthermore, the first outer pocket 22 and the second outer pocket 24 will be fabricated from identical materials as the center pocket 20.

Figure 2:
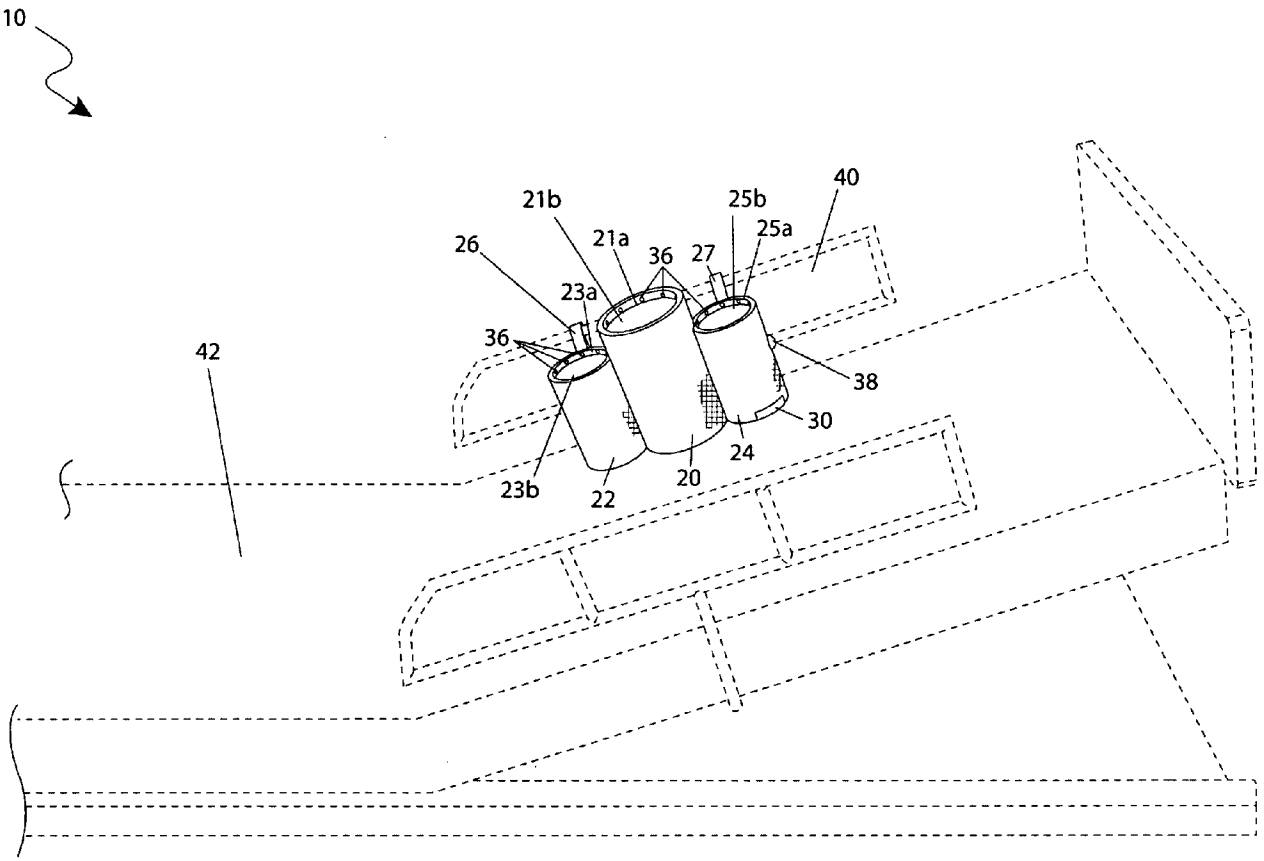
FIG. 2 is an environmental view of the textile-based holding apparatus 10 depicting placement thereon a railing 40 of a bed 42, according to a preferred embodiment of the present invention.

Referring now to FIG. 2, an environmental view of the apparatus 10 depicting placement thereon the railing 40 of the bed 42, according to the preferred embodiment of the present invention, is disclosed. The apparatus 10 is secured to the railing 40 of the bed 42 by a securing means, herein illustrated by the first strap 26 and the second strap 27 each originating from the top rear portion 15 of the apparatus 10. The first strap 26 and the second strap 27 are each secured in place preferably with conventional hook-and-loop fasteners such as VELCRO®, yet other fastening means such as, but not limited to: snaps, buckles, or the like may be utilized without limiting the functions of the apparatus 10. The apparatus 10 is depicted here comprising a hook-and-loop fastener having a hook side 28 and a loop side 29 (also see FIG. 3). The hook side 28 is located at a distal end of the first strap 26 and the second strap 27. The loop side 29 is located on a rear outside surface of the first outer pocket 22 and the second outer pocket 24. The first strap 26 and the second strap 27 are fabricated from a strong nylon, yet other materials may be utilized without limiting the functions of the apparatus 10. The first strap 26 and the second strap 27 allow the apparatus 10 to be secured to the railing 40 of the bed 42 quickly and easily and allows for attachment to any make or model of hospital bed on the market. Furthermore, the simple design would also allow the apparatus 10 to be easily secured to a couch or mounted on a vertical surface. Also, the design allows a nurse or doctor to remove the apparatus 10 quickly to perform a medical test, obtain a vital sign, or other similar tasks, and then easily return a patient's personal items stored in the apparatus 10 to the railing 40 of the bed 42.

Figure 3:
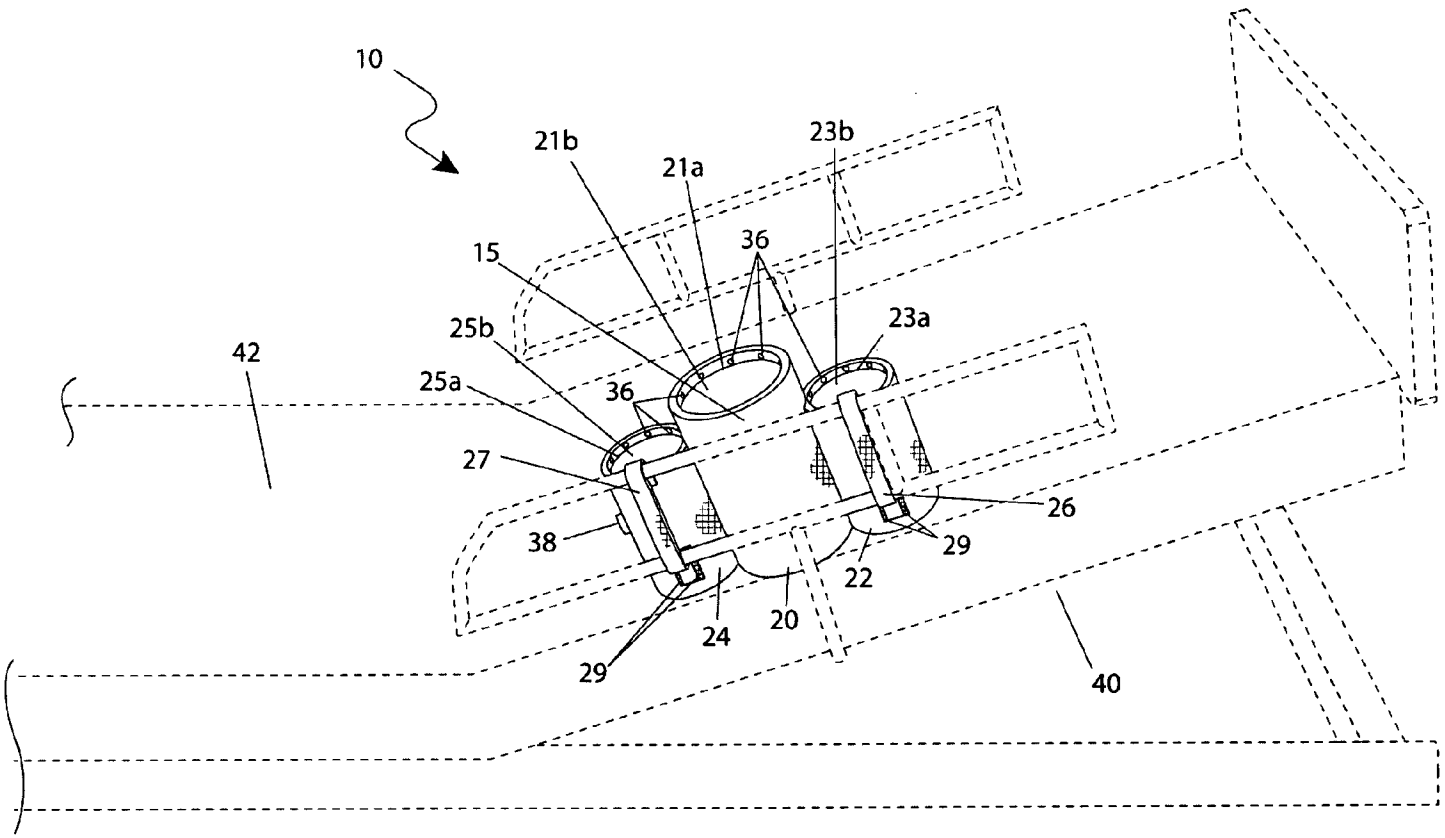
FIG. 3 is another environmental view of the textile-based holding apparatus 10 depicting a rear view of placement thereon a railing 40 of a bed 42, according to a preferred embodiment of the present invention.

Referring now to FIG. 3, another environmental view of the apparatus 10 depicting a rear view of placement thereon the railing 40 of the bed 42, according to the preferred embodiment of the present invention, is disclosed. The first strap 26 and second strap 27 are attached by looping each over the top of the railing 40 and then connecting the hook side 28 located thereon the end of the first strap 26 and the second strap 27 thereto the loop side 29 which is located thereon the rear outside surface of the first outer pocket 22 and the second outer pocket 24. This feature allows for an adjustable attachment means that can be varied depending on the size of the railing 40 and the apparatus 10 could be connected to all makes and models of hospital beds 42 or other structures. The first strap 26 and second strap 27 provide for a strong connection that is easily applied and removed without the use of tools and the apparatus 10 can be easily transferred from bed to bed.

Figure 4:
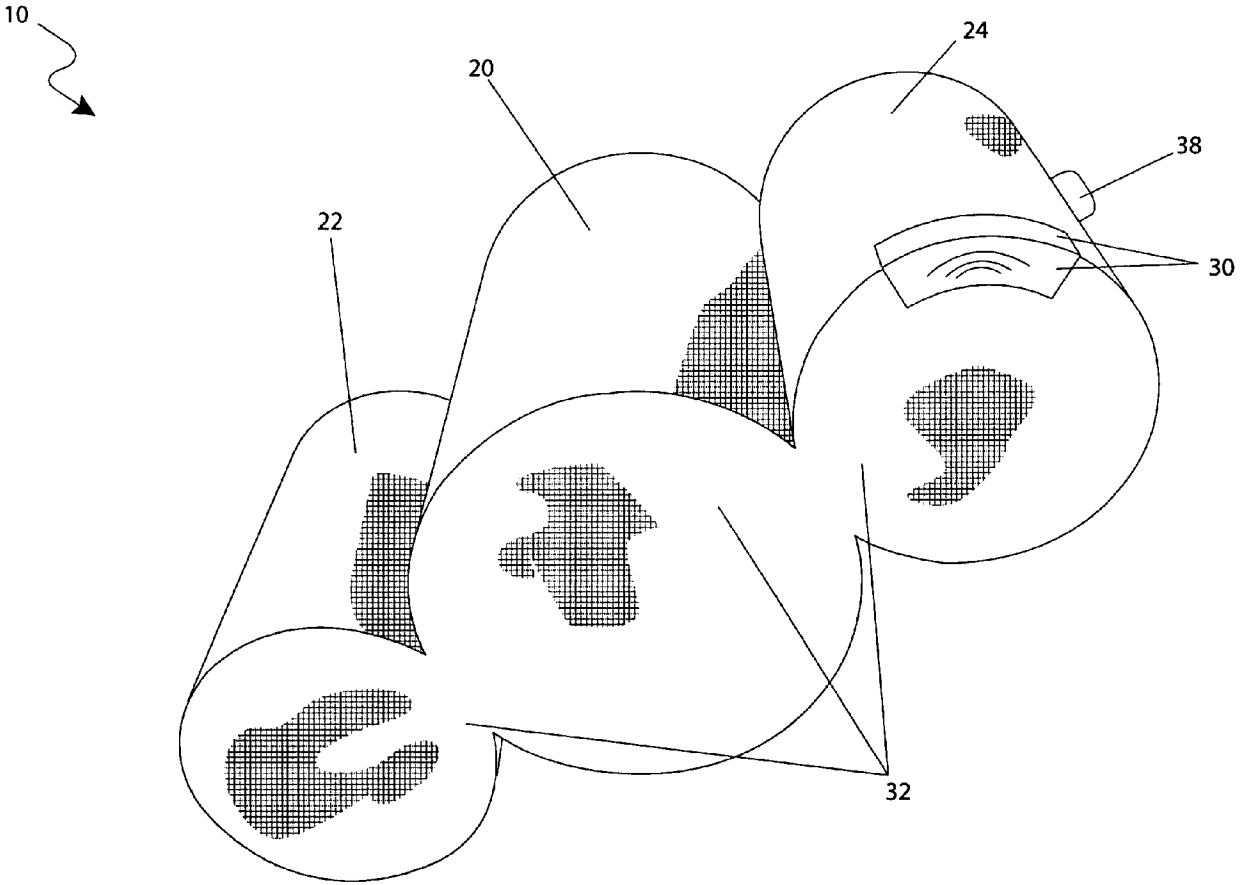
FIG. 4 is a bottom perspective view of the textile-based holding apparatus 10, according to a preferred embodiment of the present invention.
Figure 5:
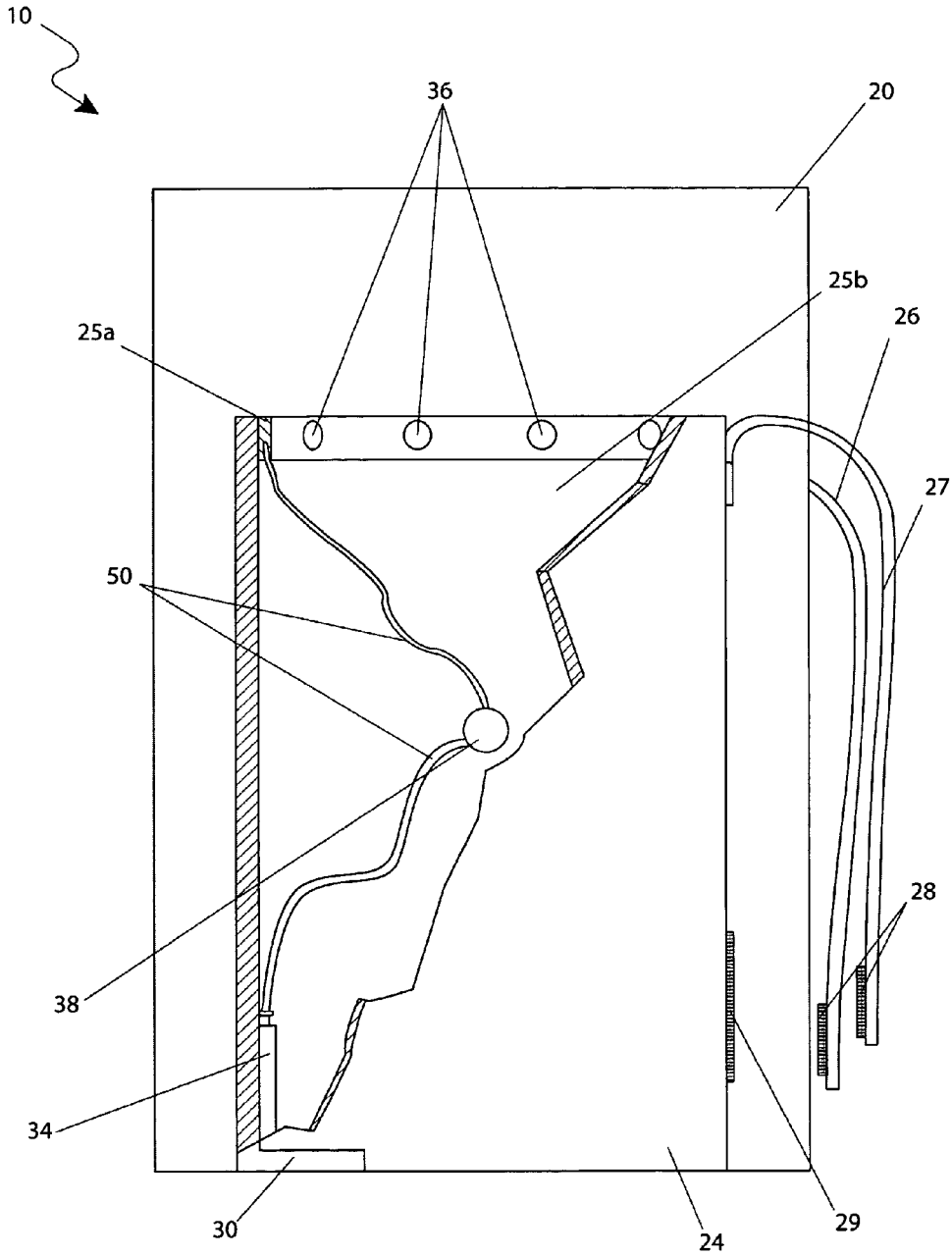
FIG. 5 is a side cut-away view of the textile-based holding apparatus 10, according to a preferred embodiment of the present invention; and, FIG. 6 is an electronic block diagram of an electrical circuit 39 incorporated into the textile-based holding apparatus 10, according to a preferred embodiment of the present invention.

Referring now to FIG. 4, a bottom view of the apparatus 10 and FIG. 5, a side cut-away view of the apparatus 10, according to a preferred embodiment of the present invention, are disclosed. The bottom portion 32 of the apparatus 10 comprises a solid base, thereby providing a supporting means to items placed there inside via the pocket openings 21*b*, 23*b*, 25*b*. The apparatus 10 also comprises a battery storage compartment 30 which retains a conventional user replaceable battery 34 therewithin and supplies a current which illuminates the light source 36. Said light source 36 is controlled via an on/off switch 38 located on a side of the second outer pocket 24, yet other locations of the switch 38 may be utilized without limiting the features of the apparatus 10. The switch 38 is preferably a conventional single pole, single throw on/off switch such as, but not limited to: a push button, a slide switch, a toggle switch, or the like and is located thereon an intermediate exterior side portion of the second outer pocket 24 as abovementioned. The battery compartment 30 is located thereon a partial bottom portion 32 and extends upwardly thereon a partial side portion of the second outer pocket 24, yet other positions may also be utilized.

Figure 6:
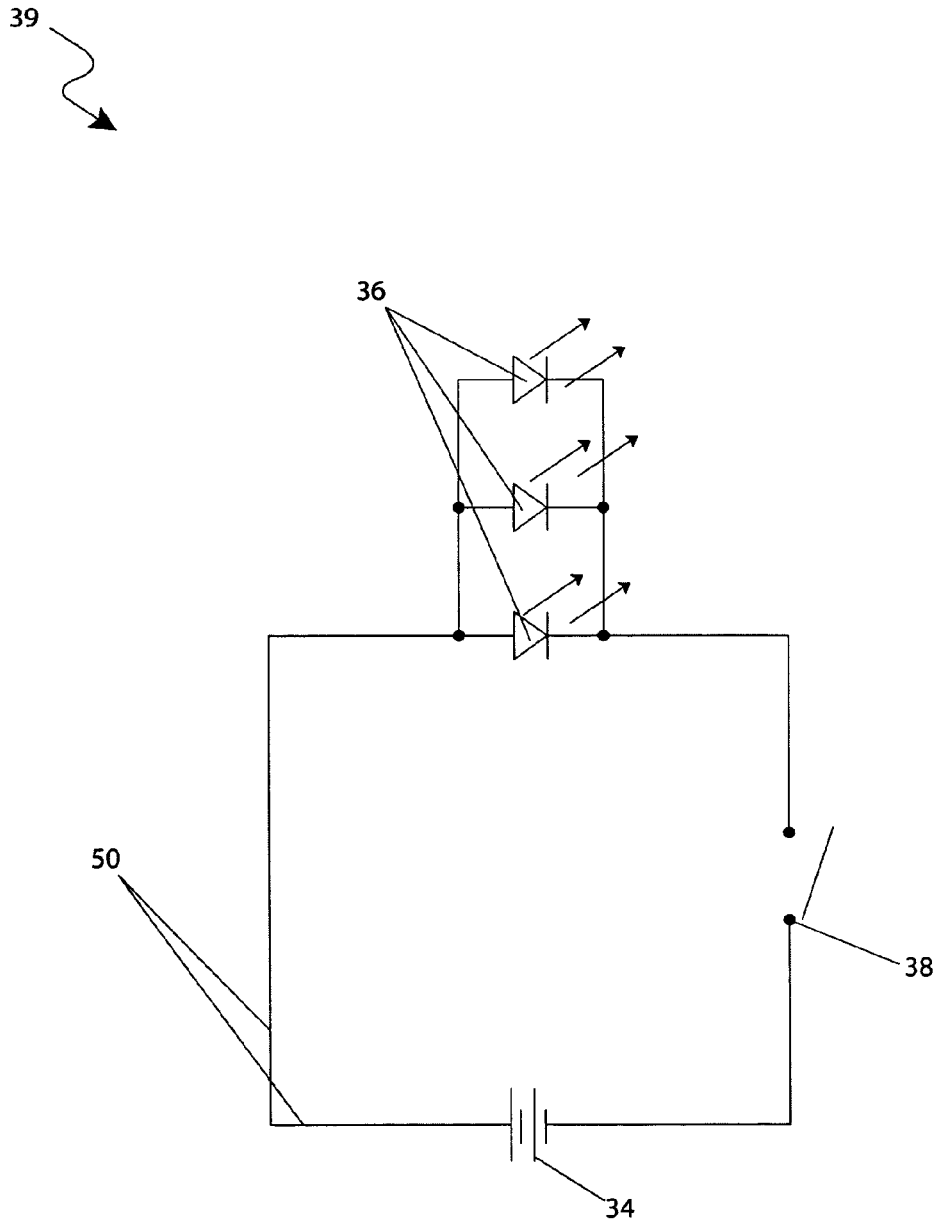

Referring now to FIG. 6, an electronic block diagram of an electrical circuit 39 incorporated into the apparatus 10, according to a preferred embodiment of the present invention, is disclosed. The electrical circuit 39 comprises the battery 34, a light source 36, and the switch 38. Said switch 38 is interconnected to the battery 34 and light source 36 therewith appropriately gauged conventional electrical wiring 50. In use, when the switch 38 is positioned to the contact position, it closes the electrical circuit 39, thereby allowing the battery 34 to supply current to the light source 36 which enables said light source 36 to illuminate.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be configured as indicated in FIG. 1 and installed as indicated in FIGS. 2 and 3.

The method of utilizing the apparatus 10 may be achieved by performing the following steps: acquiring the apparatus 10; placing a battery 34 within the battery storage compartment 30; locating and providing a desired attachment point for the apparatus 10, such as the railing 40 of the bed 42; looping the first strap 26 and the second strap 27 thereover the railing 40 of the bed 42; adjusting the first strap 26 and the second strap 27 to fit the railing 42; fastening the hook side 28 located at the distal end of the first strap 26 and the second strap 27 to the loop side 29 located on the rear outside surface of the first outer pocket 22 and the second outer pocket 24 for a secure attachment; placing desired personal items therein said center pocket 20, first outer pocket 22, and second outer pocket 24; placing oversized items therein said center pocket 20; depressing or sliding the switch 38 thereto supply current to the light source 36 and illuminate the pockets 20, 22, 24 as necessary; depressing or sliding the switch 38 again thereto discontinue current to the light source 36 as necessary; removing the apparatus 10 from the railing 40 of the bed 42 as necessary; and, organizing important items in a manner which is not only quick, easy and effective, but reduces the possibility of loss and associated aggravation.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit, or scope of the claims of the present invention.

What is claimed is:

1. A storage device, further comprising:

a plurality of pockets affixed thereto each other, each comprising a cylindrical body with a closed and weighted bottom end, an open top end providing access thereinto an interior;

an illumination means, further comprising:

an illumination source disposed therealong an inner periphery thereof a rim thereof said open top end of each of said plurality of pockets;

a power switch located on an exterior surface thereof one (1) of said plurality of pockets and in electrical communication therewith said illumination source; and, a power source housed within a compartment located thereat a bottom portion thereof one (1) of said plurality of pockets and in electrical communication therewith said power switch; and, a plurality of support straps each attached thereto a rear outer surface thereof said plurality of pockets at a proximal end and comprising a removable attachment means;

wherein a desired amount of larger personal items and smaller personal items are removably stored therewithin said interior thereof each of said plurality of pockets;

wherein said weighted bottom end provides a secure supporting means thereto said desired amount of larger personal items and said desired amount of smaller personal items;

wherein said plurality of support straps provides a means for removably attaching said storage device thereto a support structure; and, wherein said removable attachment means further comprises a length adjustable means for supporting said storage device thereon a variety of said support structures.

2. The storage device of claim 1, wherein said illumination means further comprises a string of light-emitting diodes (LED's).

3. The storage device of claim 1, wherein said plurality of pockets further comprises:

a center pocket located centrally thereof said storage device, comprising dimensions thereby enabling storage of said desired amount of larger personal items;

a first outer pocket, comprising dimensions thereby enabling storage of said desired amount of smaller personal items and affixed thereto a first side thereof said center pocket along a vertical edge thereof; and, a second outer pocket, comprising dimensions thereby enabling storage of said desired amount of smaller personal items and affixed thereto a second side thereof said center pocket along a vertical edge thereof;

wherein said bottom end thereof each of said center pocket, said first outer pocket, and said second outer pocket are conterminous.

4. The storage device of claim 3, wherein said dimensions thereof said center pocket further comprises approximately eight (8) inches in height by six (6) inches in diameter.

5. The storage device of claim 3, wherein said dimensions thereof said first outer pocket and said second outer pocket each further comprise approximately three (3) inches in height by six (6) inches in diameter.

6. A storage device, further comprising:

a center pocket located centrally thereof said storage device, comprising a cylindrical body with a closed and weighted bottom end, and an open top end providing access thereinto an interior;

a first outer pocket affixed thereto a first side thereof said center pocket along a vertical edge thereof, comprising a cylindrical body with a closed and weighted bottom end, and an open top end providing access thereinto an interior; and, a second outer pocket affixed thereto a second side thereof said center pocket along a vertical edge thereof, comprising a cylindrical body with a closed and weighted bottom end, and an open top end providing access thereinto an interior;

an illumination means, further comprising:

an illumination source disposed therealong an inner periphery thereof a rim thereof said open top end of each of said center pocket, said first outer pocket, and said second outer pocket;

a power switch located on an exterior side surface thereof said second outer pocket and in electrical communication therewith said illumination source; and, a power source housed within a compartment located a partial bottom portion and extending upwardly thereon a partial side portion of said second outer pocket and in electrical communication therewith said power switch;

a first support strap attached thereto a rear outer surface thereof said first outer pocket at a first proximal end and comprising a removable attachment means; and, a second support strap attached thereto a rear outer surface thereof said second outer pocket at a second proximal end and comprising a removable attachment means;

wherein said bottom end thereof each of said center pocket, said first outer pocket, and said second outer pocket are conterminous;

wherein a desired amount of larger personal items are stored therewithin said interior thereof said center pocket;

wherein a desired amount of smaller personal items are removably stored therewithin said interior thereof each of said first outer pocket and said second outer pocket;

wherein said weighted bottom end provides a secure supporting means thereto said desired amount of larger personal items and said desired amount of smaller personal items;

wherein said first support strap and said second support strap each provide a means for removably attaching said storage device thereto a support structure; and, wherein said removable attachment means further comprises a length adjustable means for supporting said storage device thereon a variety of said support structures.

7. The storage device of claim 6, wherein said illumination means further comprises a string of light-emitting diodes (LED's).

8. The storage device of claim 6, wherein said center pocket further comprises dimensions of approximately eight (8) inches in height by six (6) inches in diameter.

9. The storage device of claim 6, wherein said first outer pocket and said second outer pocket each further comprise dimensions of approximately three (3) inches in height by six (6) inches in diameter.

10. The storage device of claim 6, wherein said removable attachment means each further comprise a hook-and-loop-type fastener, further comprising:

a first hook side located on an exterior surface thereof a first distal end portion of said first support strap;

a second hook side located on an exterior surface thereof a second distal end portion of said second support strap;

a first loop side located thereon a rear outer surface thereof said first outer pocket subjacent thereto said first support strap; and, a second loop side located thereon a rear outer surface thereof said second outer pocket subjacent thereto said second support strap;

wherein said first hook side is removably attachable thereto said first loop side; and, wherein said second hook side is removably attachable thereto said second loop side.

11. The storage device of claim 6, wherein said support structure is a hospital bed railing.

* * * * *